US007733305B2

(12) United States Patent
Nishimura et al.

(10) Patent No.: US 7,733,305 B2
(45) Date of Patent: Jun. 8, 2010

(54) PLASMA DISPLAY DEVICE AND METHOD FOR DRIVING A PLASMA DISPLAY PANEL

(75) Inventors: Masaru Nishimura, Yamanashi-ken (JP); Tsutomu Tokunaga, Yamanashi-ken (JP); Kazuaki Sakata, Yamanashi-ken (JP); Atsushi Hirota, Yamanashi-ken (JP); Hai Lin, Yamanashi-ken (JP)

(73) Assignee: Panasonic Corporation, Osaka (JP)

( * ) Notice: Subject to any disclaimer, the term of this patent is extended or adjusted under 35 U.S.C. 154(b) by 1259 days.

(21) Appl. No.: 11/130,406

(22) Filed: May 17, 2005

(65) Prior Publication Data

US 2005/0253787 A1 Nov. 17, 2005

(30) Foreign Application Priority Data

May 17, 2004 (JP) ..... 2004-146425
Jul. 12, 2004 (JP) ..... 2004-204157
Nov. 22, 2004 (JP) ..... 2004-337646

(51) Int. Cl.
*G09G 3/28* (2006.01)

(52) U.S. Cl. ..... 345/67; 345/60; 315/169.2; 315/169.3; 315/169.4; 313/586

(58) Field of Classification Search ..... 345/60, 345/67; 315/169.4, 169.2, 169.3; 313/586
See application file for complete search history.

(56) References Cited

U.S. PATENT DOCUMENTS

| | | | | |
|---|---|---|---|---|
| 6,486,611 | B2 * | 11/2002 | Tokunaga et al. | 315/169.4 |
| 7,333,076 | B2 * | 2/2008 | Nakamura et al. | 345/60 |
| 2002/0008817 | A1 | 1/2002 | Ito et al. | |
| 2004/0051689 | A1 | 3/2004 | Nakamura et al. | |
| 2004/0075388 | A1 * | 4/2004 | Miyashita et al. | 313/586 |

FOREIGN PATENT DOCUMENTS

| | | | |
|---|---|---|---|
| CN | 1254153 | A | 5/2000 |
| CN | 1327253 | A | 12/2001 |
| EP | 1 441 239 | A1 | 7/2004 |
| EP | 1 594 115 | A2 | 1/2005 |
| EP | 1 591 988 | A | 11/2005 |
| JP | 2756053 | | 11/1993 |
| JP | 07-192630 | A | 7/1995 |
| TW | 493204 | B | 7/2002 |
| TW | 578186 | B | 3/2004 |

OTHER PUBLICATIONS

Saksena et al. Cathodo-Luminescence of MgO, Jun. 8, 1954, National Physical Laboratory of India, New Delhi, India, pp. 814-815.*

Grant et al. ("Time resolved luminescence spectroscopy of alkaline earth oxides after pulsed electron beam irradiation. II. Spectra and thresholds of MgO", J. Chem. Phys. 90 (1989) 807).*

Chinese Office Action dated Jul. 13, 2007 issued in Chinese Application No. 2005100728861.

* cited by examiner

*Primary Examiner*—Henry N Tran
*Assistant Examiner*—Viet Pham
(74) *Attorney, Agent, or Firm*—Sughrue Mion, PLLC

(57) ABSTRACT

There are provided a plasma display device in which dark contrast can be enhanced without deteriorating an image quality and a method of driving a plasma display panel. In a case of driving a plasma display device in which a magnesium oxide layer containing a magnesium oxide crystal to be excited by the irradiation of an electron beam and performing a cathode luminescence having a peak in a wavelength range of 200 to 300 nm by a sub-field method, in order to initialize all display cells, reset discharge is caused in each of the display cells in M sub-fields of N consecutive sub-fields (0<M<N).

20 Claims, 11 Drawing Sheets

V3 - V3 SECTION

V3 - V3 SECTION

W2 - W2 SECTION

V3 - V3 SECTION

W2 - W2 SECTION

PLASMA DISPLAY DEVICE AND METHOD FOR DRIVING A PLASMA DISPLAY PANEL

BACKGROUND OF THE INVENTION

1. Field of the Invention

The present invention relates to a plasma display device having a plasma display panel and a method for driving the plasma display panel.

2. Description of the Related Art

Recently, a display device having a large screen and a reduced thickness has been demanded and various thin display devices have been put to practical use. An AC discharge-type plasma display panel (hereinafter, refer to as a PDP) has been noticed as one of such thin display devices. The PDP has a front transparent substrate serving as a display screen and a rear substrate. A plurality of row electrodes are formed on the front transparent substrate and a plurality of column electrodes are formed on the rear substrate so as to cross the plurality of row electrodes. Between the front transparent substrate and the rear substrate, a discharge space which is filled with a discharge gas is formed. Pixel cells serving as pixels are formed at respective intersections of the row electrodes and the column electrodes including the discharge space.

In order to perform a display with grayscale level luminance in such a PDP, grayscale driving is performed based on a sub-field method. For example, a method of grayscale-driving a PDP in which each of frames of an input video signal is divided to eight sub-fields, and a full-scale write period, a full-scale erasure period, an address period, and a sustain discharge period are provided for each sub-field has been suggested (for example, see FIG. 5 in Japanese Patent No. 2756053). At this time, in the full-scale write period, a predetermined amount of wall charges is formed in all pixel cells by forcibly causing write discharge in all pixel cells. Further, through the write discharge, priming particles by the amount required for causing discharge in the address period described later are formed in all pixel cells. Specifically, the write discharge caused in the full-scale write period is referred to as initialization discharge through which the priming particles for surely causing discharge in each address period are formed and the amount of the wall charges over all pixel cells are uniform. Next, in the full-scale erasure period, the wall charges formed in all pixel cells are erased by causing erasure discharge with respect to all pixel cells. In the address period, the write discharge is selectively caused with respect to each of the pixel cells according to display data and the wall charges are formed in only pixel cells to be turned on. Then, in the sustain discharge period, sustain discharge is repeatedly performed with respect to only pixel cells in which the wall charges are formed, by the number of times assigned to each of the sub-fields. By driving in such a manner, a display is performed with a grayscale level luminance corresponding to times the sustain discharge is caused in each of the eight sub-fields.

However, since the light emission due to the initialization discharge (write discharge) caused in the full-scale write period has no relation with an actual display image, contrast at the time of displaying a relatively dark image, that is, dark contrast is deteriorated. Accordingly, a driving method in which the full-scale write period is provided in only a head sub-field of each of the eight sub-fields and the initialization discharge is caused in the full-scale write period of the head sub-field so as to suppress dark contrast from deteriorating has been suggested (for example, see FIG. 2 in Japanese Patent No. 2756053).

However, when the number of times of the initialization discharge in a display period of one field (frame) is simply reduced, the priming particles in each pixel cell become insufficient. Therefore, there is a problem in that the selective discharge may be not surely caused in the address period and an image quality may be deteriorated.

SUMMARY OF THE INVENTION

The invention has been made to solve the problems, and it is an object of the invention to provide a plasma display device which can enhance dark contrast without deteriorating image quality and a method of driving a plasma display panel.

According to an aspect of the invention, a plasma display device in which a plasma display panel provided with display cells having a discharge space at intersections of a plurality of row electrode pairs and a plurality of column electrodes arranged to cross the plurality of row electrode pairs is driven for respective N sub-fields to display images for one frame. The plasma display device includes a magnesium oxide layer that is formed in each of the display cells and contains a magnesium oxide crystal to be excited by the irradiation of an electron beam to perform a cathode luminescence having a peak in a wavelength range of 200 to 300 nm, an address portion that sequentially applies a scanning pulse to one electrodes of the respective row electrode pairs in each sub-field and applies a data pulse corresponding to an input video signal to cause selective discharge in the discharge space of each of the display cells and to set the respective display cells to a turned-on cell state or a turned-off cell state, a sustain portion that applies a sustain pulse to the respective row electrode pairs in each sub-field to cause sustain discharge in the discharge space of each of the display cells set to the turned-on cell state; and a reset portion that applies a reset pulse to the respective row electrode pairs in M sub-fields of the N sub-fields ($0<M<N$) to cause reset discharge in the discharge space of each of the display cells and to initialize all the display cells.

According to another aspect of the invention, a method of driving a plasma display panel which is provided with display cells having a magnesium oxide layer, which contains a magnesium oxide crystal to be excited by the irradiation of an electron beam to perform a cathode luminescence having a peak in a wavelength range of 200 to 300 nm, and a discharge space facing the magnesium oxide layer, formed at intersections between a plurality of row electrode pairs and a plurality of column electrodes arranged to cross the plurality of row electrode pairs, for respective N sub-fields to display images for one frame. The method of driving a plasma display panel includes an address step of causing selective discharge in the discharge space of each of the display cells based on an input video signal in the respective sub-fields to set each of the display cells to a turned-on cell state or a turned-off cell state, a sustain step of causing sustain discharge in the discharge space of each of the display cells set to the turned-on cell state in the respective sub-fields, and a reset step of causing reset discharge in the discharge space of each of the display cells in M sub-fields of the N sub-fields ($0<M<N$) to initialize all the display cells.

DESCRIPTION OF THE PREFERRED EMBODIMENTS

Hereinafter, an embodiment of the invention will be described with reference to the drawings.

Figure 1:
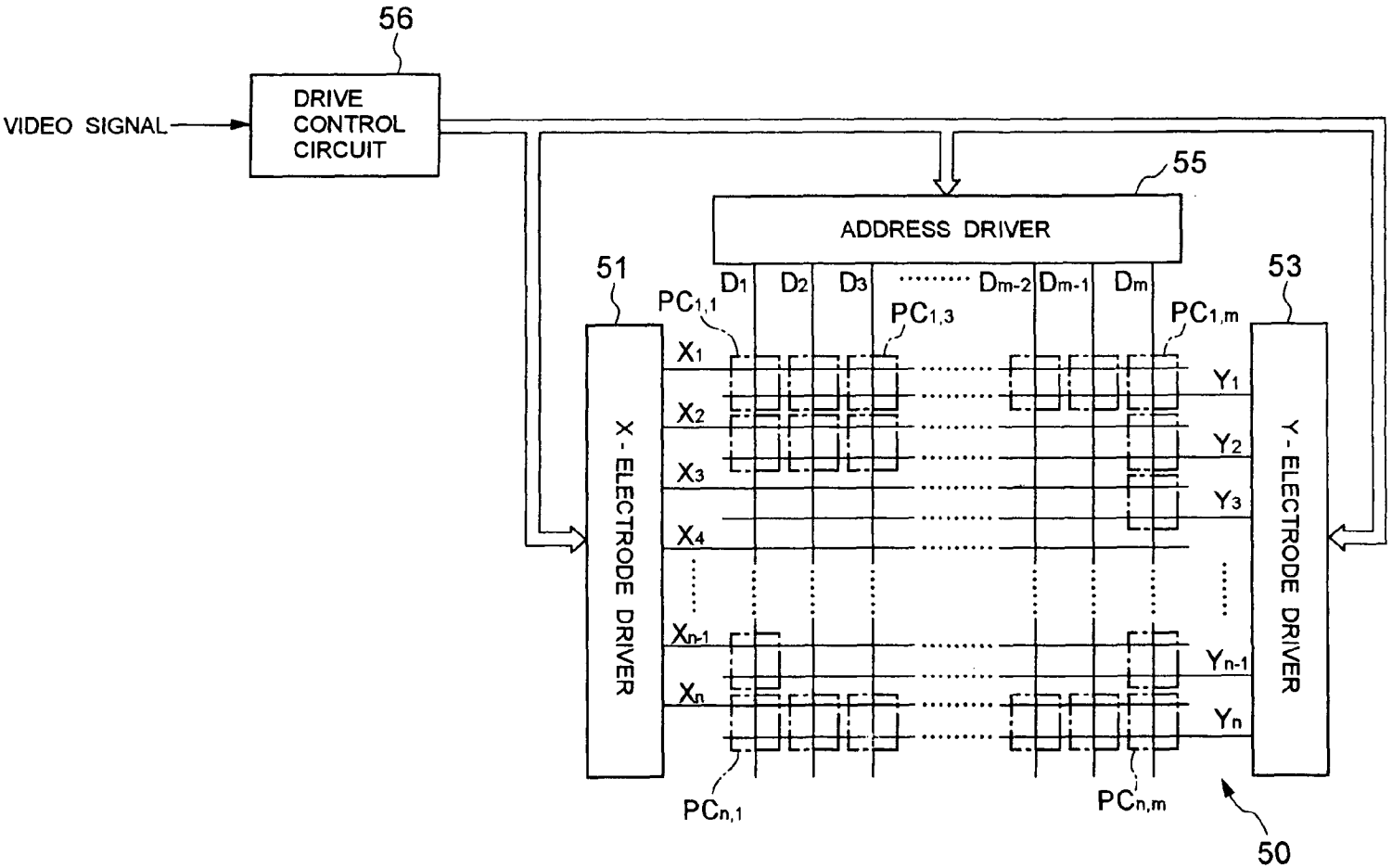
FIG. 1 is a diagram showing a schematic configuration of a plasma display device according to the invention.

FIG. 1 is a diagram showing a schematic configuration of a plasma display device according to the invention.

As shown in FIG. 1, such a plasma display device includes a PDP 50 as a plasma display panel, an X electrode driver 51, a Y electrode driver 53, an address driver 55, and a drive control circuit 56.

In the PDP 50, column electrodes $D_1$ to $D_m$ arranged to extend in a longitudinal direction (vertical direction) of a two-dimensional display screen and row electrodes $X_1$ to $X_n$ and row electrodes $Y_1$ to $Y_n$ arranged to extend in a traverse direction (horizontal direction) of the two-dimensional display screen are formed. At this time, the row electrode pairs $(Y_1, X_1)$, $(Y_2, X_2)$, $(Y_3, X_3)$, . . . , $(Y_n, X_n)$, which are formed in such a manner that the adjacent row electrodes are in pairs, serve as a first display line to an n-th display line in the PDP 50, respectively. At respective intersections between the display lines and the column electrodes $D_1$ to $D_m$ (in regions surrounded by one-dot-chain lines in FIG. 1), display cells PC serving as pixels are formed. Specifically, in the PDP 50, the display cells $PC_{1,1}$ to $PC_{1,m}$ belonging to in the first display line, the display cells $PC_{2,1}$ to $PC_{2,m}$ belonging to in the second display line, . . . , and the display cells $PC_{n,1}$ to $PC_{n,m}$ belonging to in the n-th display line are arranged in a matrix shape.

Figure 2:
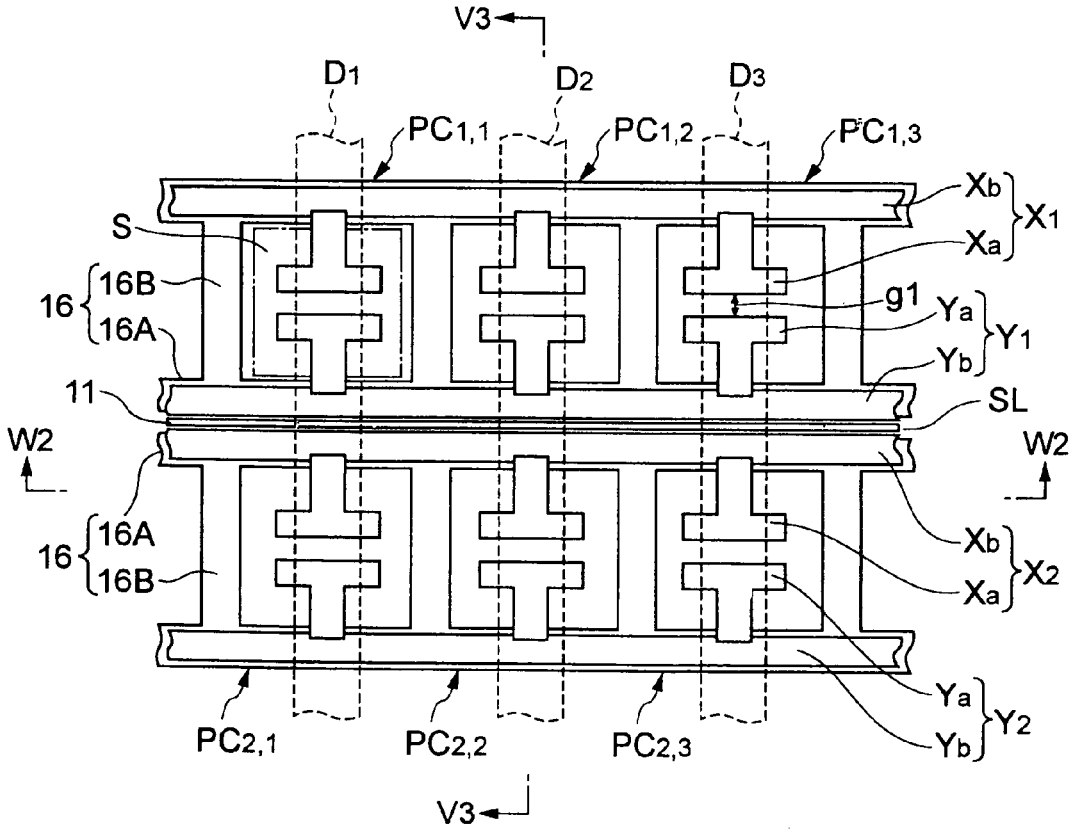
FIG. 2 is a front view schematically showing an internal structure of a PDP 50 as viewed from a display surface.
Figure 3:
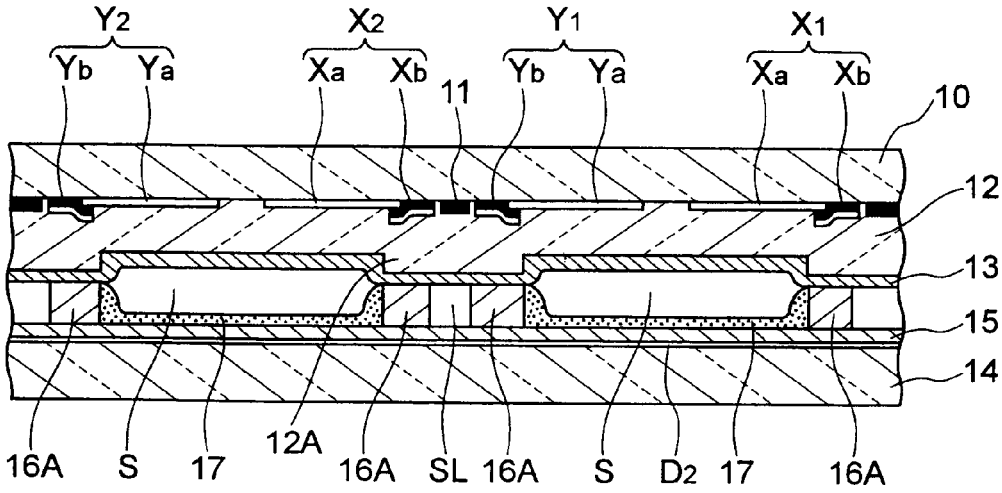
FIG. 3 is a diagram showing a section taken along the line V3-V3 in FIG. 2.
Figure 4:
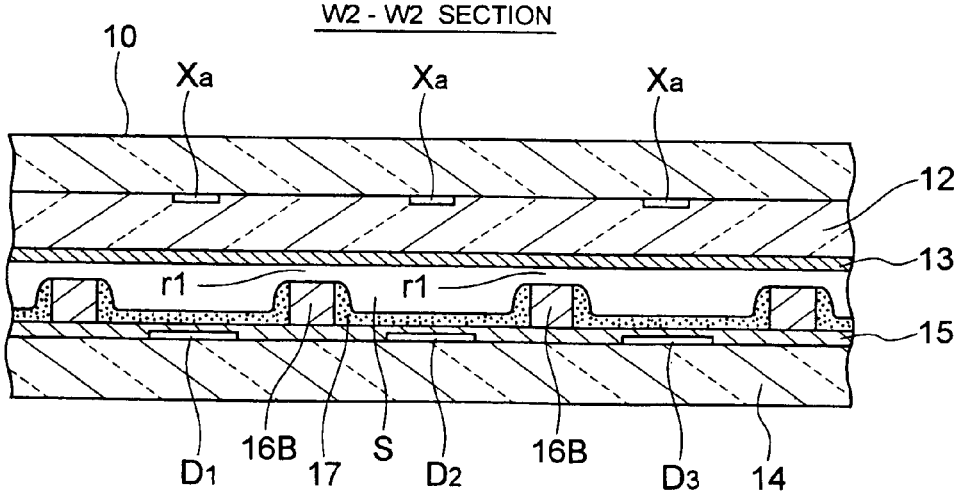
FIG. 4 is a diagram showing a section taken along the line W2-W2 in FIG. 2.

FIG. 2 is a front view showing an internal structure of the PDP 50 as viewed from a display surface. Further, in FIG. 2, only the respective intersections of the column electrodes $D_1$ to $D_3$ and the first display line $(Y_1, X_1)$ and the second display line $(Y_2, X_2)$ are shown. Also, FIG. 3 is a diagram showing a section of the PDP 50 taken along the line V3-V3 and FIG. 4 is a diagram showing a section of the PDP 50 taken along the line W2-W2.

As shown in FIG. 2, each row electrode X has a bus electrode Xb provided to extend in the horizontal direction of the two-dimensional display screen and a T-shaped transparent electrode Xa provided in a position corresponding to each display pixel PC on the bus electrode Xb. Each row electrode Y has a bus electrode Yb provided to extend in the horizontal direction of the two-dimensional display screen and a T-shaped transparent electrode Ya provided in a position corresponding to each display pixel PC on the bus electrode Yb. The transparent electrodes Xa and Ya are made of, for example, transparent conductive films of ITO, and the bus electrodes Xb and Yb are made of, for example, metal films. The row electrode X having the transparent electrode Xa and the bus electrode Xb and the row electrode Y having the transparent electrode Ya and the bus electrode Yb are formed on a rear surface of a front transparent substrate 10 of which a front surface serves as a display surface of the PDP 50, as shown in FIG. 3. At this time, one of the transparent electrodes Xa and Ya in each row electrode pair (X, Y) extend toward the other of the row electrodes in pairs, and the top sides of the wider portions of the transparent electrodes Xa and Ya face each other at a predetermined discharge gap g1. Also, a light absorbing layer (a light shielding layer) 11 of black or dark color is formed between the adjacent row electrode pairs $(X_1, Y_1)$ and $(X_2, Y_2)$ on the rear surface of the front transparent substrate 10 to extend in the horizontal direction of the two-dimensional display screen. Further, a dielectric layer 12 is formed on the rear surface of the front transparent substrate 10 so as to cover the row electrode pairs (X, Y). On the rear surface of the dielectric layer 12 (a surface opposite to the surface with which the row electrode pairs come in contact), as shown in FIG. 3, a bulk dielectric layer 12A is formed at a portion corresponding to a region where the light absorbing layer 11 and the bus electrodes Xb and Yb adjacent to the light absorbing layer 11 are formed.

On the surfaces of the dielectric layer 12 and the bulk dielectric layer 12A, a magnesium oxide layer 13 containing a magnesium oxide single crystal is formed. The magnesium oxide single crystal is excited by the irradiation of an electron beam to perform a cathode luminescence having a peak in a wavelength range of 200 to 300 nm. The magnesium oxide single crystal includes a vapor-phase magnesium oxide crystal obtained by heating magnesium and by oxidizing magnesium in a vapor phase. A structure of the vapor-phase magnesium oxide crystal has, for example, a polycrystalline structure in which crystals are engaged with each other, as shown in an SEM photographic image of FIG. 5A or a cube single crystal structure, as shown in an SEM photographic image of FIG. 5B. An average particle diameter thereof is equal to or more than 500 angstroms and preferably, equal to or more than 2000 angstroms (based on the measurement result by a BET method). In such a manner, as shown in FIG. 6, the magnesium oxide layer 13 is formed by attaching the vapor-phase magnesium oxide single crystal 13B to the surface of the dielectric layer 12 in a spray method or an electrostatic coating method. Further, the magnesium oxide layer 13 may be formed by forming a thin-film magnesium oxide layer on the surface of the dielectric layer 12 through a deposition method or a sputtering method and by attaching the vapor-phase magnesium oxide single crystal to the thin-film magnesium oxide layer.

On a rear substrate 14 provided parallel to the front transparent substrate 10, each column electrode D extends in a direction orthogonal to the row electrode pair (X, Y) in a position where the transparent electrodes Xa and Ya face each other. On the rear substrate 14, a column-electrode protecting layer 15 of white color is formed so as to cover the column electrodes D. On the column-electrode protecting layer 15, partition walls 16 are formed. The partition walls 16 are formed in a lattice shape to have horizontal walls 16A provided to extend in the traverse direction of the two-dimensional display screen at positions corresponding to the bus electrodes Xb and Yb of the respective row electrode pairs (X, Y) and vertical walls 16B provided to extend in the longitudinal direction of the two-dimensional display screen at intermediate positions between the adjacent column electrodes D. In each display line of the PDP 50, the partition walls 16 shown in FIG. 2 are formed in a lattice shape and a gap SL shown in FIG. 2 exists between the adjacent partition walls 16. The respective display cells PC including a separate discharge space S and the transparent electrodes Xa and Ya are partitioned by the partition walls 16 formed in the lattice shape. In the discharge space S, a discharge gas containing a xenon gas is filled. In each display cell, a phosphor layer 17 is formed on the side surface of the horizontal wall 16A, the side surface of the vertical wall 16B, and the surface of the column-electrode protecting layer 15 so as to cover all of them, as shown in FIG. 3. Actually, the phosphor layer 17 is made of three types of phosphors, that is, a phosphor which emits a red light component, a phosphor which emits a green light component, and a phosphor which emits a blue light component. As shown in FIG. 3, since the magnesium oxide layer 13 comes in contact with the horizontal wall 16A, the discharge space S of each display cell PC and the gap SL are closed. Meanwhile, as shown in FIG. 4, since the vertical wall 16B does not come in contact with the magnesium oxide layer 13, a gap r1 exists between the vertical wall 16B and the magnesium oxide layer 13. Specifically, the discharge space S of the adjacent display cells PC in the traverse direction of the two-dimensional display screen are connected with each other through the gap r1.

Figure 7:
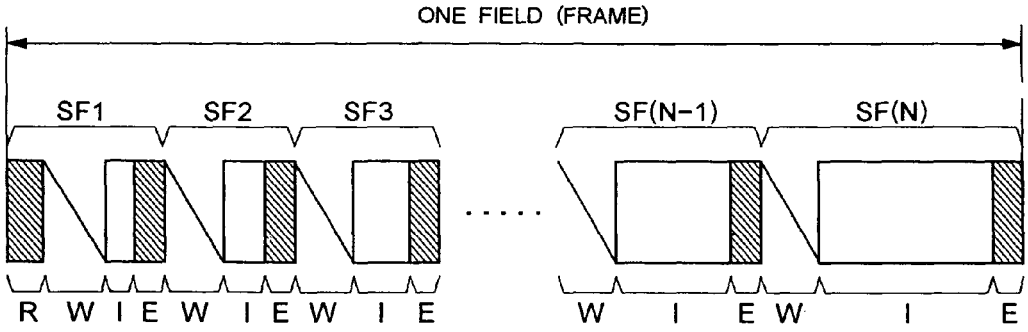
FIG. 7 is a diagram showing an example of a light emission driving sequence used in the plasma display device shown in FIG. 1.

The drive control circuit 56 supplies various control signals to the X-electrode driver 51, the Y-electrode driver 53, and the address driver 55, so as to drive them according to a light emission driving sequence using a sub-field method shown in FIG. 7. The X-electrode driver 51, the Y-electrode driver 53, and the address driver 55 generate various driving pulses described later for driving the PDP 50 according to the light emission driving sequence shown in FIG. 7 and supply them to PDP 50.

In the light emission driving sequence shown in FIG. 7, each of N sub-fields SF1 to SF(N) within one field (one frame) display period has an address period W, a sustain period I, and an erasure period E. Further, in the head sub-field SF1, a reset period R is provided before the address period W.

Figure 8:
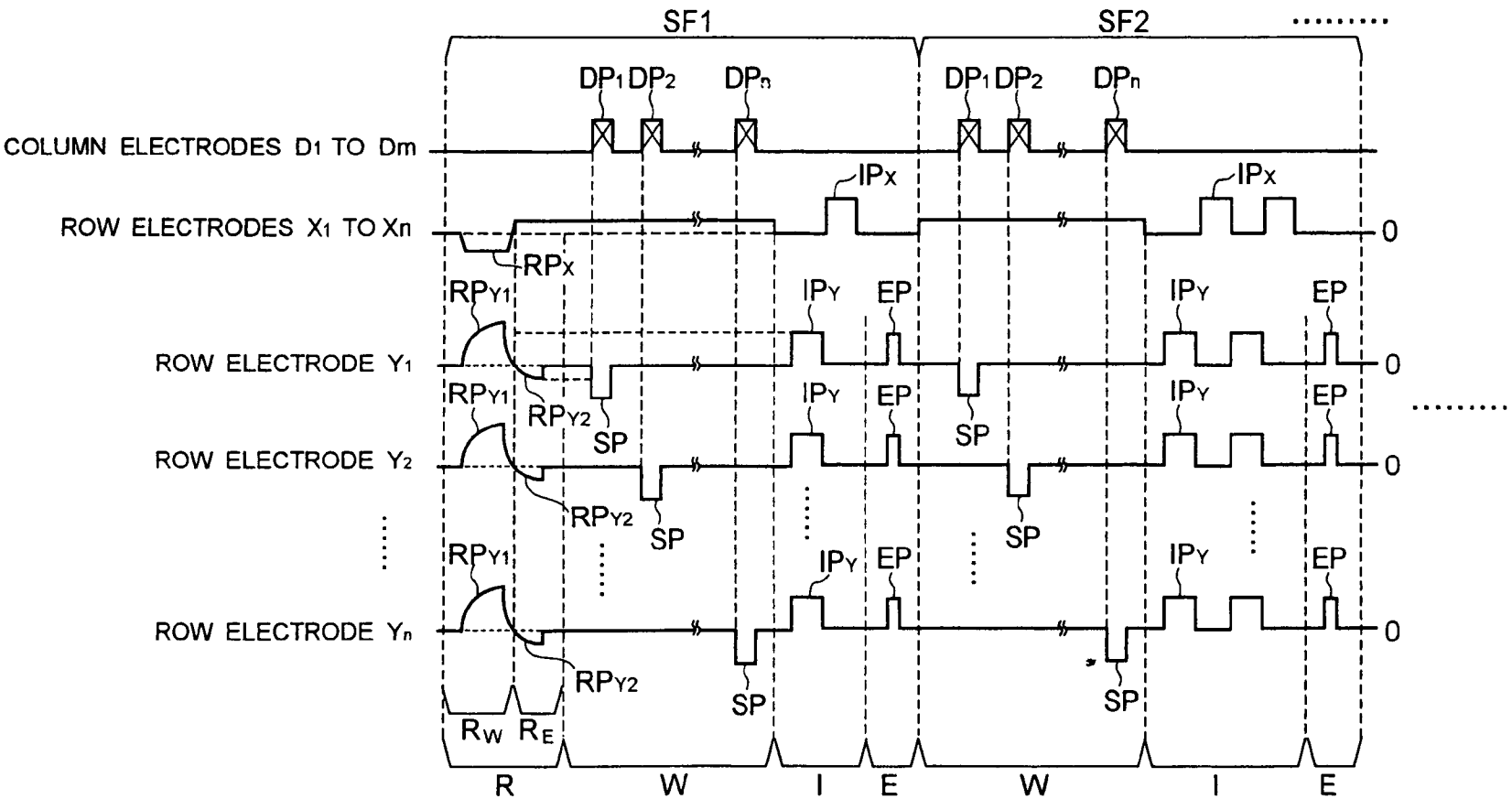
FIG. 8 is a diagram showing various pulses to be applied to the PDP 50 according to the light emission driving sequence shown in FIG. 7 and the application timings thereof.
Figure 9:
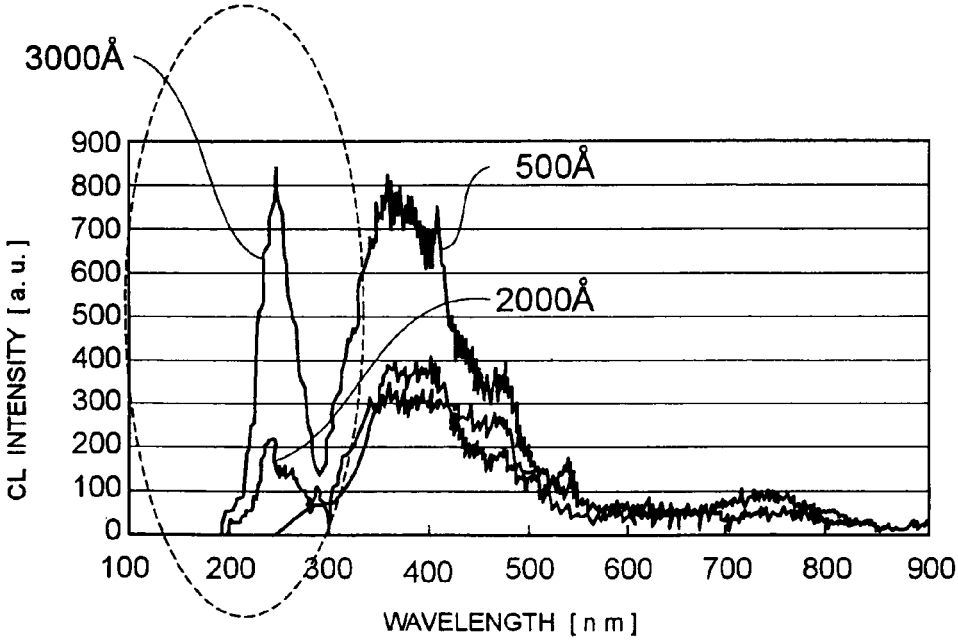
FIG. 9 is a graph showing a correspondence relationship between the wavelength of a CL which is excited at the time of the irradiation of an electron beam onto the magnesium oxide single crystal and the intensity thereof.

FIG. 8 is a diagram showing the timing at which various pulses are applied to the column electrodes D and the row electrodes X and Y of the PDP 50 in the sub-fields SF1 and SF2 from the sub-fields SF1 to SF(N).

First, in the address period W of each sub-field, the address driver 55 generates a pixel data pulse to determine which display cells PC are emitted in the sub-field based on an input video signal. For example, for each display cell, the address driver 55 generates a high-voltage pixel data pulse so as to cause the display cell PC to be emitted and generates a low-voltage pixel data pulse so as not to cause the display cell to be emitted. Then, the address driver 55 applies sequentially each pixel data pulse group $DP_1, DP_1, \ldots, DP_n$, including the pixel data pulses (m pixel data pulses) corresponding to one display line, to the row electrodes $D_1$ to $D_m$. In this case, the Y-electrode driver 53 applies a scanning pulse SP having negative polarity sequentially to the row electrodes $Y_1$ to $Y_n$ in synchronization with the timing of each of the pixel data pulse groups $DP_1$ to $DP_n$. At this time, discharge (selective discharge) is caused only in the display cells PC to which the scanning pulse SP and a high-voltage pixel data pulse are applied, and a predetermined amount of the wall charges is formed on each of the surfaces of the magnesium oxide layer 13 and the phosphor layer 17 in the discharge space S of each discharge display cell PC. Further, since the selective discharge is not caused in the display cells PC to which the scanning pulse SP and a low-voltage pixel data pulse are applied, as described above, the formation state of the wall charge immediately before is maintained.

That is, in the address period W, each display cell PC is set to any one of a turned-on cell state in which the predetermined amount of the wall charges remain and a turned-off cell state in which the wall charges is less than the predetermined amount.

Next, in the sustain period I of each sub-field, the X-electrode driver 51 and the Y-electrode driver 53 repeatedly apply sustain pulses $IP_x$ and $IP_Y$ of positive polarities to the row electrodes $X_1$ to $X_n$ and the row electrodes $Y_1$ to $Y_n$, respectively. At this time, the X-electrode driver 51 and the Y-electrode driver 53 apply the sustain pulses $IP_x$ and $IP_Y$ one after the other. Further, how many times the sustain pulses $IP_x$ and $IP_Y$ are applied depends on the weighted value of luminance in each sub-field. At this time, whenever each of the sustain pulses $IP_x$ and $IP_Y$ is applied, sustain discharge is caused only in the display cells PC which is in the turned-on cell state in which the predetermined amount of the wall charges has been formed. Further, the phosphor layer 17 emits light due to such sustain discharge, such that an image is formed on the display surface of the panel.

The reset period R provided only to the head sub-field SF1 has a full-scale write period $R_W$ and a full-scale erasure period $R_E$.

First, in the full-scale write period $R_W$, as shown in FIG. 8, the X-electrode driver 51 applies a reset pulse $RP_X$ of negative polarity to the row electrodes $X_1$ to $X_n$ all at once. Further, simultaneously with the application of the reset pulse $RP_X$, the Y-electrode driver 53 applies a first reset pulse $RP_{Y1}$ of positive polarity having a waveform, the voltage value of which gradually rises to reach a peak voltage value as the time passes, to the row electrodes $Y_1$ to $Y_n$, as shown in FIG. 8. The peak voltage value of the first reset pulse $RP_{Y1}$ is higher than the peak voltage value of the sustain pulse $IP_x$ or $IP_Y$. When the first reset pulse $RP_{Y1}$ and the negative reset pulse $RP_Y$ are simultaneously applied, first reset discharge is caused between the row electrodes X and Y of each of all display cells $PC_{1,1}$ to $PC_{n,m}$. After the end of the first reset discharge, a predetermined amount of the wall charges is formed on the surface of the magnesium oxide layer 13 in the discharge space S of each of all display cells PC. Specifically, the wall charges of positive polarity are formed near the row electrode X on the magnesium oxide layer 13 and the wall charges of negative polarity are formed near the row electrode Y on the magnesium oxide layer 13. In such a manner, the wall charges are formed.

Next, in the full-scale erasure period $R_E$, as shown in FIG. 8, the Y-electrode driver 53 generates a second reset pulse $RP_{Y2}$ of negative polarity having a waveform, the voltage value of which gradually drops as the time passes, and applies the second reset pulse $RP_{Y2}$ to all row electrodes $Y_1$ to $Y_n$ all at once. Further, the peak voltage value of the second reset pulse $RP_{Y2}$ is set within a voltage range between a voltage value on the row electrode Y at the time when the scanning pulse SP is not applied in the address period W and a peak voltage value of the scanning pulse SP. In response to the application of the second reset pulse $RP_{Y2}$, second discharge is caused between the row electrodes X and Y of each of all display cells $PC_{1,1}$ to $PC_{n,m}$. Through the second discharge, the wall charges formed in each of all display cells $PC_{1,1}$ to $PC_{n,m}$ are erased.

That is, in the reset period R, all display cells $PC_{1,1}$ to $PC_{n,m}$ are initialized to the turned-off cell state in which the wall charges do not exist.

Here, in the reset period R, when the first reset pulse having a small change in voltage at the time of rising is applied to the row electrode Y, first weak reset discharge is caused between the T-shaped transparent electrodes Ya and Xa, thereby suppressing the contrast from deteriorating.

Further, since the discharge occurs in each display cell PC at the time of the first reset discharge and at the time of the second reset discharge and the magnesium oxide layer 13 is formed in each display cell PC, a priming effect due to the reset discharge is maintained for a long time so that high speed addressing can be performed.

Figure 5A:
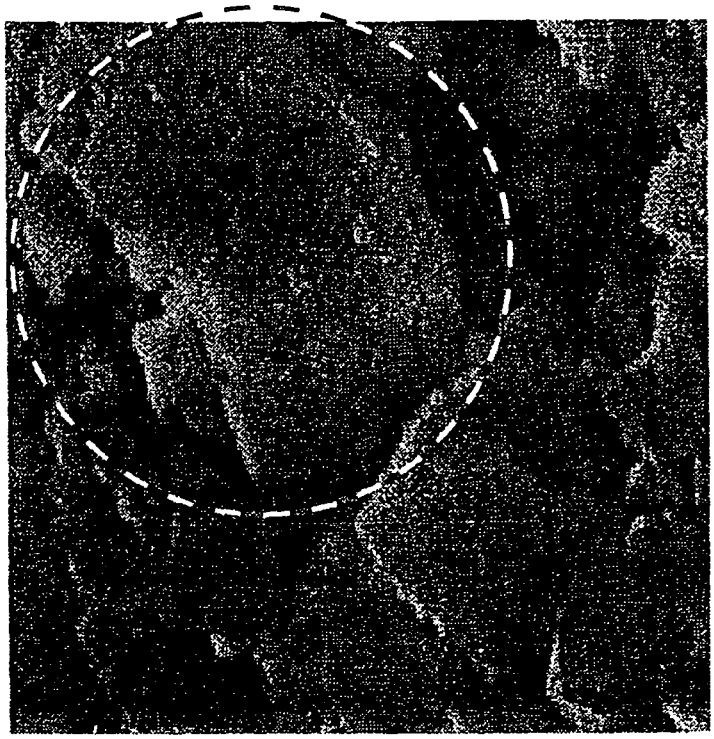
FIG. 5A is a diagram showing an example of a magnesium oxide single crystal.
Figure 5B:
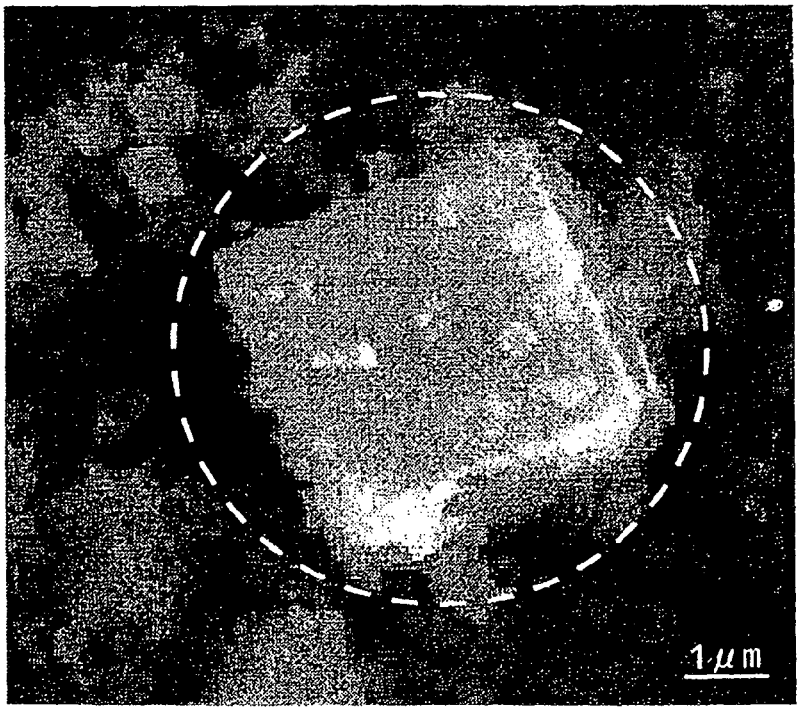
FIG. 5B is a diagram showing another example of a magnesium oxide single crystal.
Figure 6:
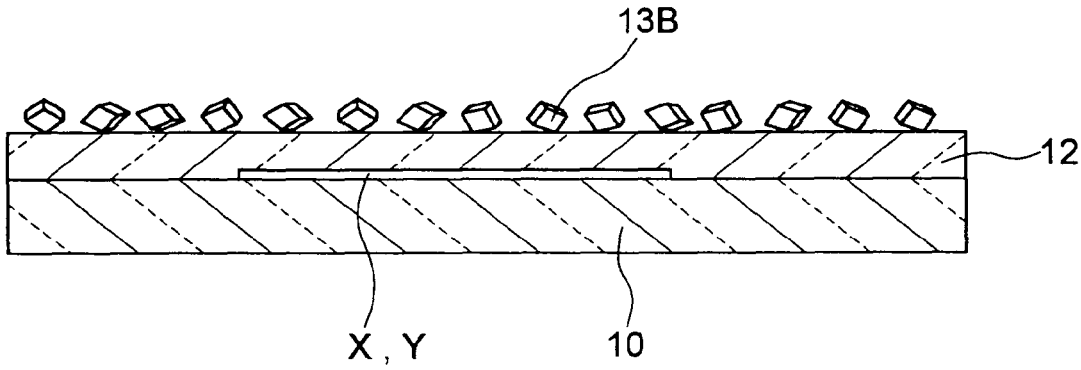
FIG. 6 is a diagram schematically showing a case in which the vapor-phase magnesium oxide single crystal 13B is attached to the surface of a dielectric layer 12 through a spray method or an electrostatic coating method.
Figure 10:
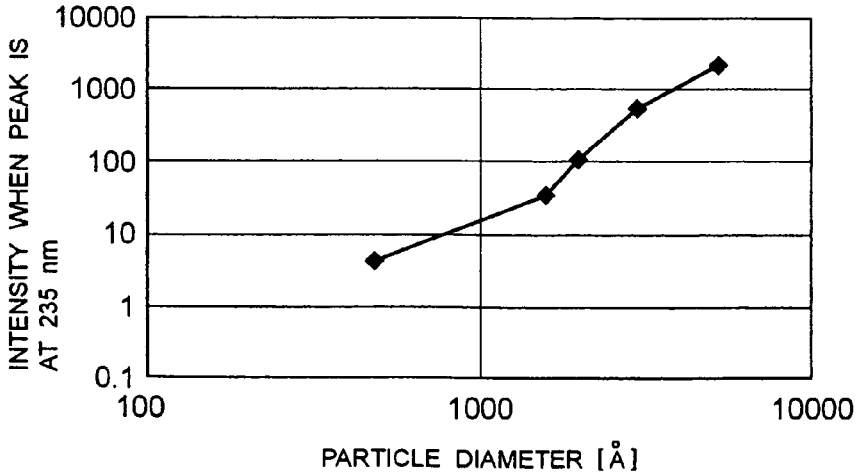
FIG. 10 is a graph showing a relationship between a particle diameter of the magnesium oxide single crystal and the intensity of the CL at 235 nm.

That is, the magnesium oxide layer 13 includes a vapor-phase magnesium oxide single crystal having a relatively large size, as shown in FIG. 5A or 5B. Since the CL (cathode luminescence) having a peak in a wavelength range of 300 to 400 nm and a CL having a peak in a wavelength range of 200 to 300 nm (in particular, about 235 nm in a range of 230 to 250 nm) are emitted when an electron beam is irradiated onto such a single crystal, the single crystal may have an energy level corresponding to 235 nm. Further, as shown in FIG. 10, in the CL having the peak in the wavelength of 235 nm, the larger the particle diameter of the vapor-phase magnesium oxide crystal is, the larger the peak intensity is. Specifically, at the time of generating the vapor-phase magnesium oxide single crystal, when magnesium is heated at a temperature higher than normal, a vapor-phase magnesium oxide single crystal having the particle diameter of 2000 angstroms and a vapor-phase magnesium oxide single crystal having an average particle diameter of 500 angstroms are formed as shown in FIGS. 5A and 5B. At this time, since the temperature at the time of heating magnesium is higher than normal, the length of a flame due to the reaction of magnesium and oxygen becomes long. Thus, a temperature difference between such a flame and a circumference becomes large, and it is estimated that lots of single crystals of a high energy level corresponding to the range of 200 to 300 nm (in particular, 235 nm) are contained in a group including a vapor-phase magnesium oxide single crystal having a large particle diameter. The vapor-phase magnesium oxide single crystal has high purity, fine particles, and little particle aggregation, as compared to a magnesium oxide obtained through other methods.

Accordingly, it is estimated that electrons are filled up to the vapor-phase magnesium oxide single crystal due to the energy level corresponding to 235 nm, as described above, and are released by the application of an electric field at the time of the selective discharge, thereby quickly obtaining initial electrons required for the discharge. Therefore, when the magnesium oxide layer 13 shown in FIG. 3 contains the vapor-phase magnesium oxide single crystal which performs the CL having a peak in the wavelength range of 200 to 300 nm at the time of the irradiation of electrons, a sufficient amount of electrons required for causing discharge exists in the discharge space S continuously, and thus the discharge probability in the discharge space S becomes drastically high.

Figure 11:
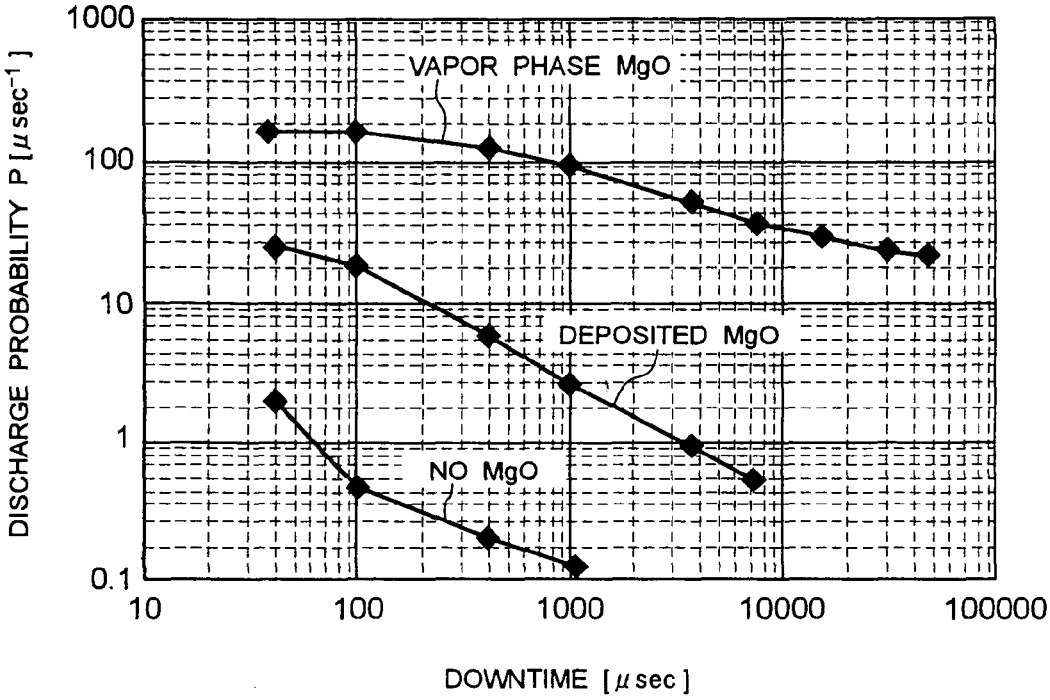
FIG. 11 is a diagram showing a discharge probability when a magnesium oxide layer is not provided in a display cell PC, a discharge probability when the magnesium oxide layer is formed by a conventional deposition method, or a discharge probability when the magnesium oxide layer containing the magnesium oxide single crystal which excites the CL having a peak in a wavelength range of 200 to 300 nm at the time of the irradiation of an electron beam is provided.

FIG. 11 is a diagram showing a discharge probability when the magnesium oxide layer is not provided in the display cell PC, a discharge probability when the magnesium oxide layer is formed by a conventional deposition method, or a discharge probability when the magnesium oxide layer containing the vapor-phase magnesium oxide single crystal which performs the CL having the peak in the wavelength range of 200 to 300 nm at the time of the irradiation of an electron beam is provided.

Figure 12:
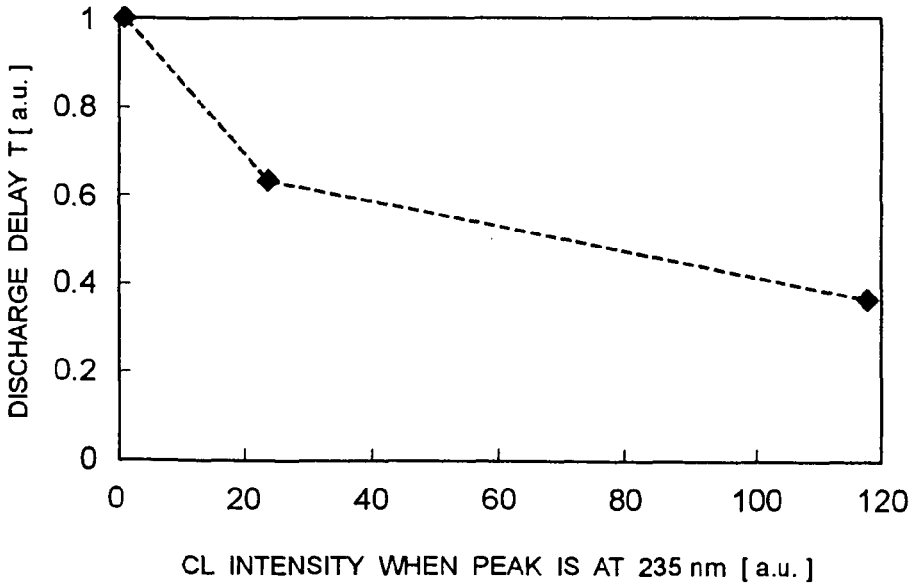
FIG. 12 is a diagram showing a correspondence relationship between the discharge delay time and the intensity of the CL having the peak at the wavelength of 235 nm.

In FIG. 11, the horizontal axis shows the downtime at which discharge is not caused. The downtime means an interval from the time when discharge occurs to the time when the next discharge occurs. When the magnesium oxide layer 13 containing the vapor-phase magnesium oxide single crystal which performs the CL having the peak in the wavelength range of 200 to 300 nm through the irradiation of an electron beam is provided, a discharge probability is increased, as compared to the case in which the magnesium oxide layer is formed by a conventional deposition method. Further, as shown in FIG. 12, a vapor-phase magnesium oxide single crystal which performs the CL having a high intensity, in particular, the CL having the peak and the high intensity at the wavelength of 235 nm at the time of the irradiation of the electron beam may be used as the above-described vapor-phase magnesium oxide single crystal, and thus it is possible to shorten a discharge delay in the discharge space S.

As such, since the discharge probability in the discharge space S is drastically high, even if the occurrence frequency of the first reset discharge for each field (frame) display period is once in the reset period R of the sub-field SF1, the selective discharge can be surely caused in the address period W of each sub-field.

Moreover, in the example shown in FIG. 7, the first reset discharge is caused in only the sub-field SF1 of the N sub-fields SF1 to SF(N). Alternatively, the first reset discharge may be caused immediately before the address period W even in other sub-fields.

In summary, in M (M<N) sub-fields of all sub-fields SF1 to SF(N) in one field (frame) display period, the first reset discharge is preferably caused so as to initialize the formation state of the wall charges of each display cell PC.

Therefore, according to the invention, since it is possible to surely cause the selective discharge in the address period W of each sub-field even if the occurrence frequency of the reset discharge in one field (frame) is low, it is possible to display a good image with enhanced dark contrast without deteriorating the image quality.

Figure 13:
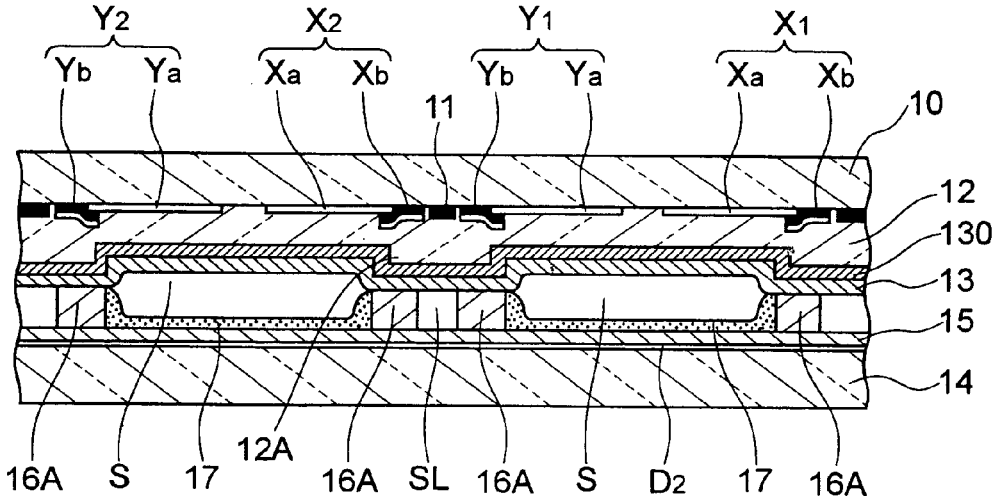
FIG. 13 is a diagram showing another example of a section taken along the line V3-V3 in FIG. 2.
Figure 14:
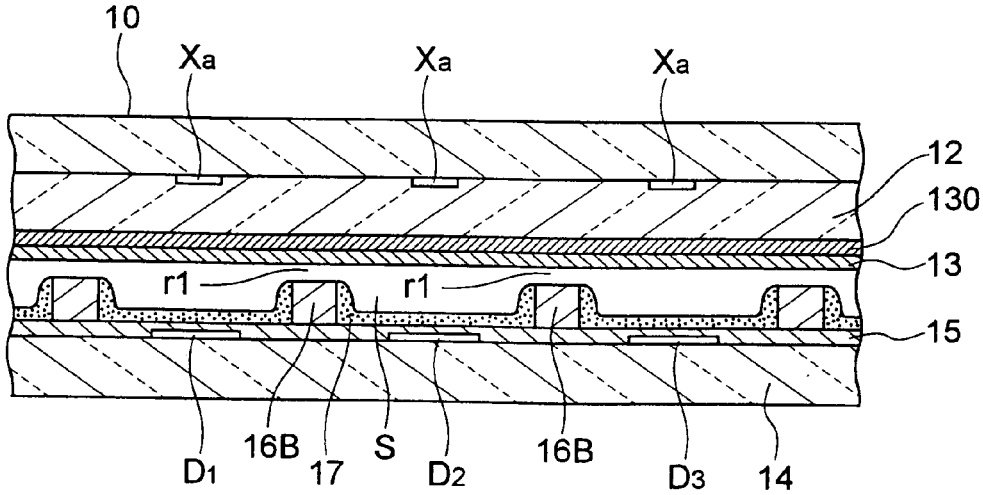
FIG. 14 is a diagram showing another example of a section taken along the line W2-W2 in FIG. 2.

Moreover, in the above-described embodiment, the magnesium oxide layer 13 containing the single crystal substance of the magnesium oxide shown in FIG. 5A or 5B is formed on the dielectric layer 12. Alternatively, a thin-film magnesium oxide layer 130 may be provided between the dielectric layer 12 and the magnesium oxide layer 13 by a deposition method or a sputtering method as shown in FIG. 13 and FIG. 14.

Figure 15:
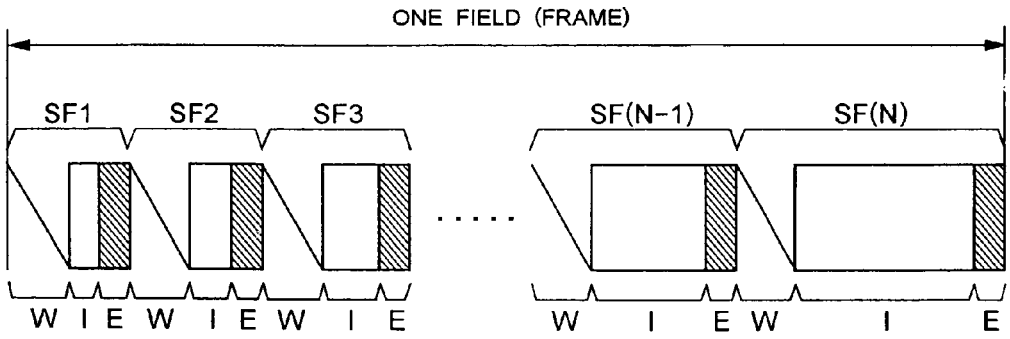
FIG. 15 is a diagram showing an example of a light emission driving sequence which is used together with the light emission driving sequence shown in FIG. 7.

Further, whenever driving is performed once or more based on the light emission driving sequence shown in FIG. 7, driving based on a light emission driving sequence in which the reset period R is not included in any one of the sub-fields SF1 to SF(N) shown in FIG. 15 may be performed once or more. In such a manner, since the occurrence frequency of the first reset discharge performed per unit time is reduced, it is possible to further increase dark contrast. This application is based on a Japanese patent application No. 2004-337646 which is hereby incorporated by reference.

What is claimed is:

1. A plasma display device in which a plasma display panel provided with display cells having a discharge space formed at intersections of a plurality of row electrode pairs and a plurality of column electrodes arranged to cross said row electrode pairs is driven for respective N sub-fields to display images for one frame, said plasma display device comprising:

a dielectric layer covering the plurality of row electrode pairs, a magnesium oxide layer comprising magnesium oxide crystals disposed on the dielectric layer and facing the discharge space, the magnesium oxide crystals including magnesium oxide single crystals that cause a cathode luminescence having a peak in a wavelength range of 200 to 300 nm when an electron beam is irradiated on to the magnesium oxide single crystals and that have a particle diameter of 2000 angstroms or more;

an address portion that applies a scanning pulse sequentially to one electrode of each of said row electrode pairs and applies a data pulse corresponding to an input video signal to cause selective discharge in said discharge space of each of the display cells and to set each of said display cells to a turned-on cell state or a turned-off cell state in each of said sub-fields;

a sustain portion that applies a sustain pulse to said row electrode pairs in each of said sub-fields to cause sustain discharge in said discharge space of each of said display cells set to said turned-on cell state; and a reset portion that applies a reset pulse to said row electrode pairs in M sub-fields of said N sub-fields ($0<M<N$) to cause reset discharge in said discharge space of each of said display cells and to initialize all said display cells.

2. The plasma display device according to claim 1, wherein each row electrode of said row electrode pairs have a main body portion provided to extend in a row direction and a projecting portion provided to project from said main body portion in a column direction, such that the projecting portions of the respective row electrodes face each other via a discharge gap.

3. The plasma display device according to claim 2, wherein said projecting portion of each row electrode has a wide portion in a vicinity of said discharge gap and a narrow portion that connects said wide portion to said main body portion.

4. The plasma display device according to claim 1, wherein said magnesium oxide layer contains a magnesium oxide single crystal obtained by heating magnesium and by oxidizing magnesium in a vapor phase.

5. The plasma display device according to claim 1, wherein said magnesium oxide crystal performs a cathode luminescence having a peak in a wavelength range of 230 to 250 nm.

6. The plasma display device according to claim 1, wherein said magnesium oxide layer is formed on a dielectric layer which covers said row electrode pairs.

7. The plasma display device according to claim 1, wherein said reset pulse has a section in which a voltage value thereof changes gradually as the time passes.

8. The plasma display device according to claim 1, wherein a predetermined amount of wall charges is formed in said discharge space of each of said display cells according to said reset discharge.

9. The plasma display device according to claim 1, wherein said reset discharge has first reset discharge in which the predetermined amount of the wall charges is formed in each of said display cells and second reset discharge in which the wall charges formed in each of said display cells are erased.

10. The plasma display device according to claim 1, wherein said reset pulse has a first reset pulse, the voltage value of which gradually increases as the time passes, and a second reset pulse, the voltage value of which gradually decrease as the time passes.

11. The plasma display device according to claim 1, wherein said reset portion causes said reset discharge once for each frame or for a plurality of continuous frames in a plurality of continuous sub-fields.

12. A method for driving a plasma display panel which is provided with display cells having a magnesium oxide layer and a discharge space facing the magnesium oxide layer, formed at intersections between a plurality of row electrode pairs and a plurality of column electrodes arranged to cross the plurality of row electrode pairs, for respective N sub-fields to display images for one frame, said method for driving a plasma display panel comprising:

an address step for causing selective discharge in said discharge space of each of said display cells based on an input video signal in the respective sub-fields to set each of said display cells to a turned-on cell state or a turned-off cell state;

a sustain step for causing sustain discharge in said discharge space of each of said display cells set to the turned-on cell state in the respective sub-fields; and a reset step for causing reset discharge in said discharge space of each of said display cells in M sub-fields of the N sub-fields ($0<M<N$) to initialize all the display cells;

wherein said magnesium oxide layer comprises magnesium oxide crystals disposed on a dielectric layer and facing the discharge space, and the magnesium oxide crystals include magnesium oxide single crystals that cause a cathode luminescence having a peak in a wavelength range of 200 to 300 nm when an electron beam is irradiated on to the magnesium oxide single crystals and that have a particle diameter of 2000 angstroms or more.

13. The method for driving a plasma display panel according to claim 12, wherein each row electrode of said row electrode pairs has a main body portion provided to extend in a row direction and a projecting portion provided to project from said main body portion in a column direction, such that the projecting portions of the respective row electrodes face each other via a discharge gap.

14. The method for driving a plasma display panel according to claim 13, wherein said projecting portion of each of said row electrode has a wide portion in a vicinity of said discharge gap and a narrow portion that connects said wide portion to said main body portion.

15. The method for driving a plasma display panel according to claim 12, wherein said magnesium oxide layer contains a magnesium oxide single crystal obtained by heating magnesium and by oxidizing magnesium in a vapor phase.

16. The method for driving a plasma display panel according to claim 12, wherein said magnesium oxide crystal performs a cathode luminescence having a peak in a wavelength range of 230 to 250 nm.

17. The method for driving a plasma display panel according to claim 12, wherein said magnesium oxide layer is formed on a dielectric layer that covers said row electrode pairs.

18. The method for driving a plasma display panel according to claim 12, wherein a predetermined amount of wall charges is formed in said discharge space of each of said display cells according to said reset discharge.

19. The method for driving a plasma display panel according to claim 12, wherein said reset discharge has first reset discharge in which the predetermined amount of the wall charge is formed in each of the display cells and second reset discharge in which said wall charges formed in each of said display cells are erased.

20. The method for driving a plasma display panel according to claim 12, wherein, in said reset step, said reset discharge is caused once for each one frame or for a plurality of continuous frames in a plurality of continuous sub-fields.

* * * * *